US005374876A

United States Patent [19]

Horibata et al.

[11] Patent Number: 5,374,876

[45] Date of Patent: Dec. 20, 1994

[54] PORTABLE MULTI-COLOR SIGNAL LIGHT WITH SELECTIVELY SWITCHABLE LED AND INCANDESCENT ILLUMINATION

[75] Inventors: Hiroshi Horibata, Mitaka House, No. 25-20 5-Chome, Kamirenjaku, Mitaka-Shi Tokyo 181; Gunjirou Azumaya, Yokohama, both of Japan

[73] Assignee: Hiroshi Horibata, Tokyo, Japan

[21] Appl. No.: 993,603

[22] Filed: Dec. 21, 1992

[30] Foreign Application Priority Data

Dec. 19, 1991 [JP] Japan ..... 3-114284[U]
Mar. 10, 1992 [JP] Japan ..... 4-025773[U]

[51] Int. Cl.[5] ..... H05B 35/00; H05B 37/00; H05B 39/00

[52] U.S. Cl. ..... 315/313; 315/33; 315/178; 315/317; 315/362

[58] Field of Search ..... 315/33, 178, 179, 180, 315/181, 182, 183, 250, 313, 317, 362

[56] References Cited

U.S. PATENT DOCUMENTS 4,348,715 9/1982 Christensen et al. ..... 362/109
4,625,152 11/1986 Nakai ..... 315/317
4,727,289 2/1988 Uchida ..... 315/250 X
5,008,595 4/1991 Kazar ..... 315/178
5,254,910 10/1993 Yang ..... 315/313
5,256,948 10/1993 Boldin et al. ..... 315/313

FOREIGN PATENT DOCUMENTS 64-201 1/1989 Japan .
1152401 10/1989 Japan .
1168902 11/1989 Japan .
2-74701 6/1990 Japan .
2133802 11/1990 Japan .
3-69803 7/1991 Japan .
4-29101 3/1992 Japan .

*Primary Examiner*—David Mis

[57] ABSTRACT

A portable multi-color signal light having at least two color LED, such as red or blue or green or yellow, with or without covering color films, and at least one incandescent lamp, with or without covering color films. Independent switches allow for the selective operation of the LED and the incandescent lamp. The power source may be disposed within the signal light or relocated to a cell box to be worn on the belt of the user to provide weight decrease for long-term usage. The signal light may be used as a signal light for traffic control and illumination.

22 Claims, 7 Drawing Sheets

PORTABLE MULTI-COLOR SIGNAL LIGHT WITH SELECTIVELY SWITCHABLE LED AND INCANDESCENT ILLUMINATION

FIELD OF THE INVENTION

This invention relates to a multi-color signal light which may be portable and comprises at least two color lights, having at least two color light emitting diode (LED) means with or without color films and at least an incandescent means. The LED means is supposed by a stem of a printed circuit board. The LED means is inserted into an adapter in a sleeve arranged in the incandescent means to reinforce LED means for the repeated swings of the portable multi-color signal light.

BACKGROUND OF THE PRESENT INVENTION

Recently, LED Diode or Photo Diode, particularly a red LED, has been used as a portable signal light such as in night traffic control. However, a blue LED has not been used commercially as a blue signal light, in other words, a go or safe signal bemuse its brightness is very weak. Therefore, a perfect portable multi-color signal light provided both go or safe signals of blue color and the stop or danger signal of color, has not been conventional.

A lighted tool holder for releasably holding a tool, a fishing pole, etc. which constitutes structurally a main potion of the present invention, has also been suggested in U.S. Pat. No. 4,348,715.

SUMMARY OF THE PRESENT INVENTION

A multi-color signal light comprises a cell means providing at least a three step switch, a funnel means fitted inwardly of an adapter in a split sleeve assembly, and a multi-color means covered with a hood and inserted into the adapter of the funnel means to mechanically and electrically connect with the cell means. The signal light may be used for a signal or warning light for traffic control in the night or in foggy conditions. The portable multi-color signal light can also be used with a cell box means on a belt to decrease weight.

The multi-color means of the portable multi-color signal light comprises a combination of a plurality of LED means, colored films, or an incandescent bulb means. For example, the luminous combination may comprise red LED means, blue LED means and an incandescent means. Alternatively, the luminous combination may comprise red LED means, incandescent means covered with a blue film and an incandescent means. Further the luminous means combination may comprise red LED means, green LED means with or without the blue or green films and an incandescent means. Still alternatively, the luminous means combination may comprise red LED means, yellow LED means, blue or green LED means with or without blue or green films and an incandescent means. The combinations may be selected in accordance with the use of the signal light such as traffic control, a security guard, a street improvement, etc. The various color portions may be also covered with the same color films corresponding to the color LED means to be covered therewith to concentrate those colors.

A typical turn on an off circuit of the multi-color signal light may comprise a plurality, e.g., two or three color LED means connected in series with a power source and an incandescent means with or without a buzzer in parallel with the color LED means and may be controlled by a three or four step switch and two or three step switch in the circuits to turn on or off simultaneously the same color lights selectively.

The multi-color luminous means is divided into the desired chambers or portions, for example six color portions for a signal and colorless light portion for a white light and the six color means may include alternatively one or more red and blue LEDs on a central printed circuit board divided by partitions and an incandescent bulb.

The multi-color luminous means is also covered with a transparent inner tube. The surface of the inner tube is also covered with the color films or with reflective color films corresponding to each other and width of the multi-color LED means. The inner tube is further covered by an outer transparent tube having notches on an inner through surface to provide a diffused reflection of the LED.

It is an object of the present invention to provide a novel signal light, especially a portable multi-color signal light comprising at least two color LED means for traffic control, street improvement, etc. for use in the night and in the fog.

It is another object of the present invention to provide a signal light, particularly a portable multi-color signal light comprising at least a color LED means with or without reflective color films or color films and at least an incandescent means with the color reflective films or color films.

It is an another object of the present invention to provide a signal light, particularly a portable multi-color signal light, comprising at least two color LED means with or without reflective color films or color films and at least an incandescent means for a light in the night.

It is further object of the present invention to provide a signal light, particularly a multi-color signal light, comprising at least a color LED means, and at least an incandescent means with color reflective films or films respectively, and an incandescent means for illumination.

It is an another object of the present invention to provide a color hood for a signal light which comprises a set of transparent straight tubes provided a screw cover at one end or a set of transparent tapered blind tube or a set of transparent tapered through tubes provided with a screw cover at one end. The double transparent tubes comprise an inner and outer tube respectively, with the former being covered by the color reflective films or color films and the later being notched through longitudinally on an insider surface for the diffused reflection of the light emitted from the color LED portions.

It is further an object of the present invention to provide a signal light, particularly a multi-color signal light which combined with a cell box which is attached to a belt of the user and which remarkably decreases the weight of the portable signal light by replacement of the cells in the cell portion to the cell box.

It is further object of the present invention to provide switch means particularly for a multi-color signal light which controls selectively the turn on and off of the multi-color LED circuits to change the signals according to the circumstances of the traffic control, the street improvement, etc.

It is still an object of the present invention to provide a signal light, particularly a multi-color portable signal light, which comprises further a buzzer in a parallel circuit for illumination such as an incandescent bulb portion without a color film in the multi-color luminous means.

DETAILED DESCRIPTION OF THE PREFERRED EMBODIMENTS

Figure 1:
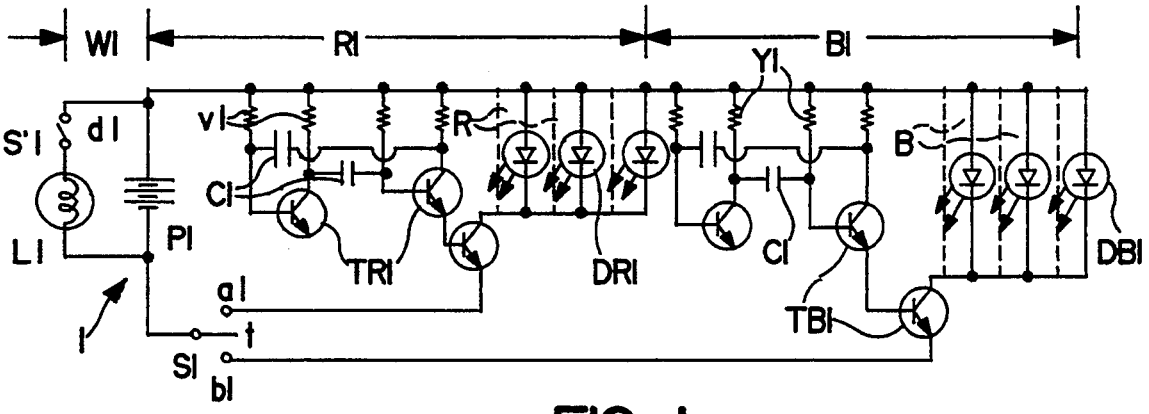
FIG. 1 shows a circuit for a multi-color signal light according to one embodiment of the present invention including color LEDs.

Referring now to the drawings and particularly FIG. 1, a multi-color signal light (1) which may be portable is illustrated as a combination of a red and blue LED means or red and blue luminous means (R1) (B1) in series with a power source (P1) and an incandescent means or an incandescent bulb portion (W1) in parallel with the red and blue LED means including a three step primary switch (S1) and a two step secondary switch (S1').

The LED means (R1)(B1) comprise respectively three red and blue LED means (R) and (B) connected electrically with three transistors (TR1) and (TB1) wherein the transistors (TR1) and (TB1) are also connected electrically with two condensers (C1) and four resistances (r1) respectively to regulate a flash interval per minute of the red and blue LEDs means.

The LED means (R1), (B1) is connected electrically in series with a power source (P1) operated by the primary switch (S1). For example, the red LED means (R1) comprising the red LEDs (DR1) is turned on by closing a contact piece (t) of the switch (S1) with a terminal (a1) of the red LED means (R1) through the transistors (TR1. The blue LED means (B1), comprising the blue LEDs (DB1), is turned on by closing the contact piece (t) with a terminal (b1) of the blue LED means (B1) through the transistor (TB1).

The incandescent means (W1) for white light is also connected electrically in parallel with the LED means (R1), (B1). An incandescent bulb (L1) is turned on and off separately from the LED means (R1)(B1) by switching of a secondary switch (S1') with a contact (d1) on a line of the power source (P1).

Figure 2:
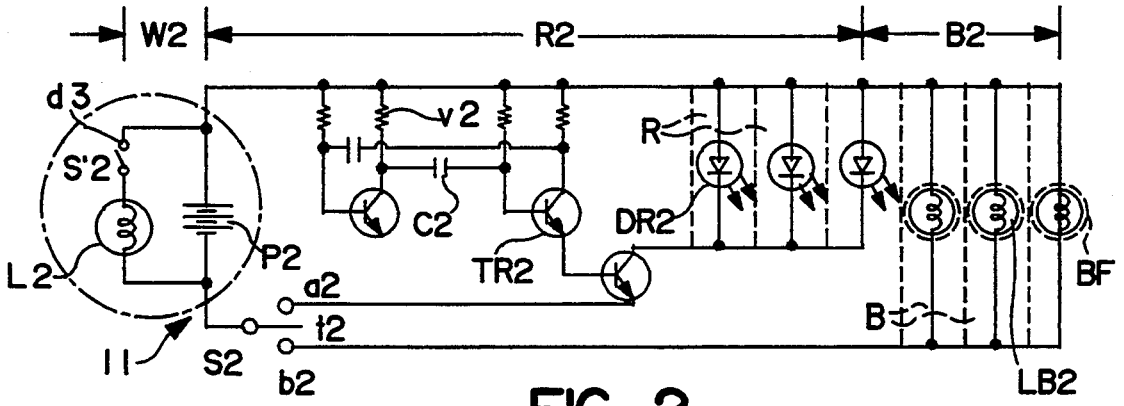
FIG. 2 shows another circuit for the multi-color signal light according to one embodiment of the present invention including the color LEDs and the incandescent bulbs covered with the reflective color films.

In FIG. 2, another embodiment of the multi-color signal light (2) is also illustrated as a combination of a red LED means (R2), a blue incandescent means (B2) in series with a power source (P2) and an incandescent means (W2) for white light in parallel with the red LED means and the blue incandescent means including a three step primary switch (S2) and a two step secondary switch (S2'). The red LED means (R2) comprises three red LED means (R) connected electrically with three transistors (TR2) wherein the transisters also are provided with two condensers (C2) and four resistances (r2) respectively to regulate a flash interval per minute of the LEDs.

The blue incandescent means (B2) may comprise incandescent bulbs covered with blue reflective films (B1F) as described hereinafter. The transistor switches and condensers used with the red LED means (R2), may also make the blue incandescent means flash light in a suitable interval. The incandescent means (W2) is also connected electrically in parallel with the red LED means (R2) and the blue incandescent means (B2) and includes an incandescent bulb (L2) for white light and a secondary switch (S2'') as in the multi-color signal light of FIG. 1.

Figure 3:
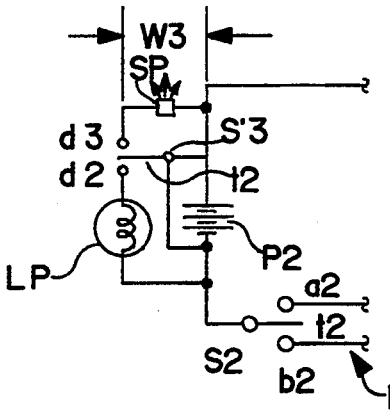
FIG. 3 shows according to one embodiment of the invention a partial circuit of the multi-color signal light circuit shown in FIG. 1 and FIG. 2, including a buzzer.

FIG. 3 shows also another embodiment of the incandescent circuit (W2) or (W1) for the illumination of the portable multi-color signal lights in FIGS. 1 and 2 and a circuit means (W3) comprising an incandescent bulb (LP), a three step switch (S'3) and a buzzer (SP). The buzzer (SP) is operated by contacting of a contact piece (t3) of the switch (S'3) with a positive terminal (d3) of the power source (P2), and the incandescent lamp (LP), by connection of the same with its positive terminal (d2) from the red LED means, etc.

The flash interval of all LEDs and the color incandescent means may be selected in a range of 1–120 times per minute and preferably in a range of 60–80 times per minute so that the light of the flash is easy to see in the night at a distance of 50 m. The flash interval may also be controlled by a selection of the value and capacity of the resistances (r1)(r2) and the condensers (c1) (c2) respectively.

Figure 4:
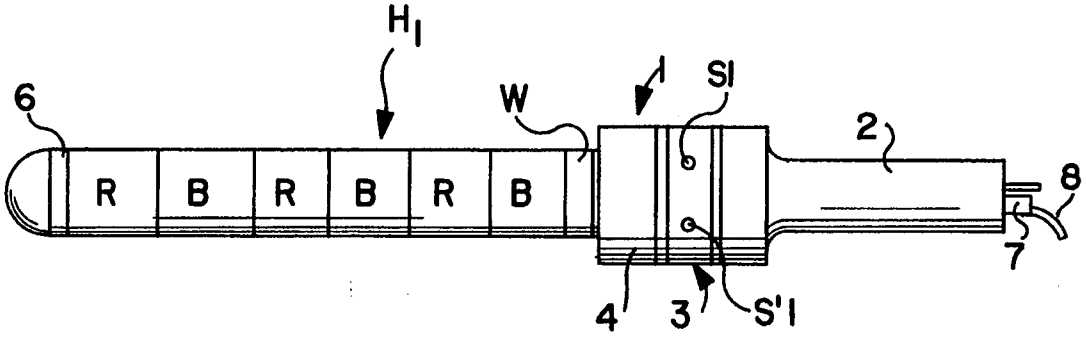
FIG. 4 shows a front view of the multi-color signal light according to one embodiment of the present invention.

In one embodiment, as shown in FIG. 4, the multi-color signal light (1) of FIG. 1 comprises structurally a cell means (2), a funnel means (3), hood connection (4), a multi-color luminous means (5) covered with a hood (H1) which is a set of straight tubes, and a cover portion (6).

Figure 5:
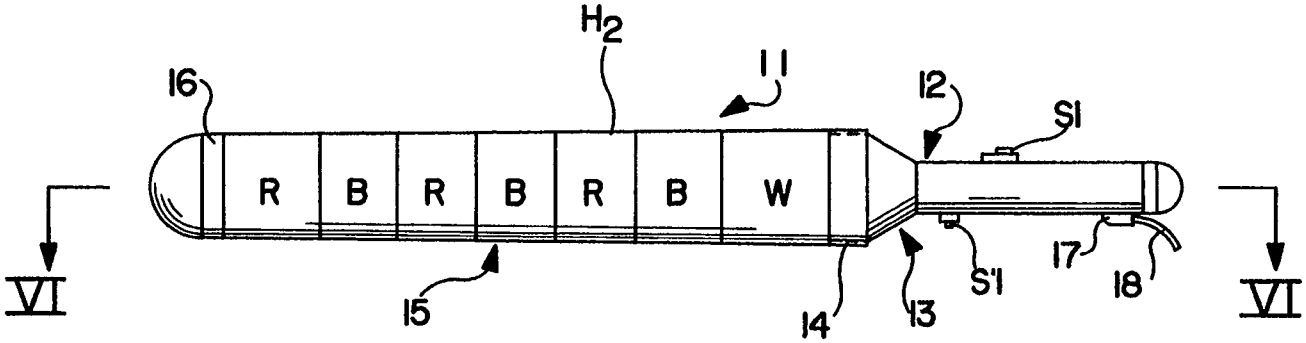
FIG. 5 shows a front view of an another multi-color signal light according to one embodiment of the present invention.

In another embodiment, as shown in FIG. 5, the multi-color signal light of FIG. 2 comprises structurally substantially the same means and construction as described in FIG. 1 except for a hood connection (14) and a hood (H2) which is a set of double tapered through tubes or a set of double tapered blind tubes.

Figure 6:
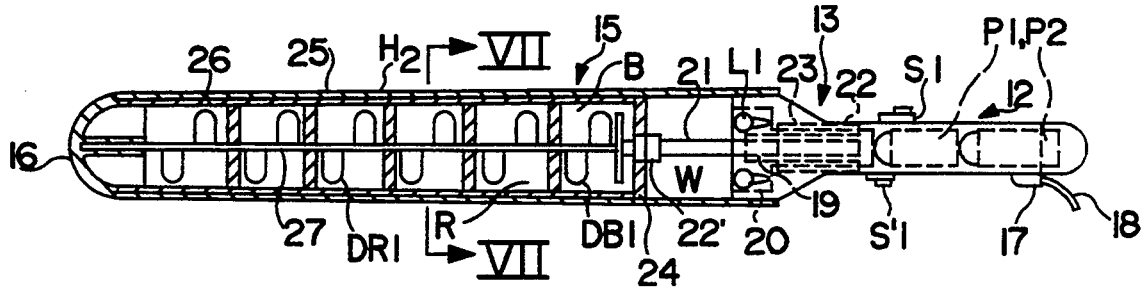
FIG. 6 shows a cross-sectional view of the signal light in FIG. 5.

The cell means (2) and (12) are respectively coupled mechanically with the funnel means (3) and (13) of the multi-color signal light (1) and (11) and includes a power source, such as cells (P1) or (P2). As shown in FIG. 6, an incandescent bulb (L1) or (L2) is screwed into a cup-like plate (20) and connected to the cells (P1) or (P2) through an out-wardly extending flanges (22). The out-wardly extending flanges (22) are held firmly in a split sleeve assembly (23) with adapter (19) for a stem (21) of a printed circuit board (27), and the multi-color luminous means (5) and (15) are turned on or off by a primary switch (s1) and a secondary switch (S1') connected electrically with the incandescent means or means (W) and the red and blue LED means or means (R), (B). The principle of illumination for the incandescent means (W) and of the adapter (19) in the split sleeve assembly (23) for supporting the stem (21), is disclosed in U.S. Pat. No. 4,348,715.

The multi-color luminous means (5) of FIG. 4 is substantially the same as the multi-color luminous means (15) of FIG. 5 except for the hood (H1) which comprises a set of straight tubes and the hood connection (4) which couples inwardly the hood (H1), as described hereinbefore.

Figure 7:
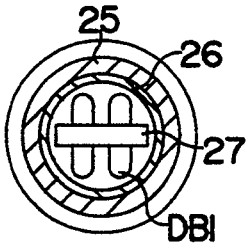
FIG. 7 shows a cross-sectional view of the multi-color signal light in FIG. 6.
Figure 10:
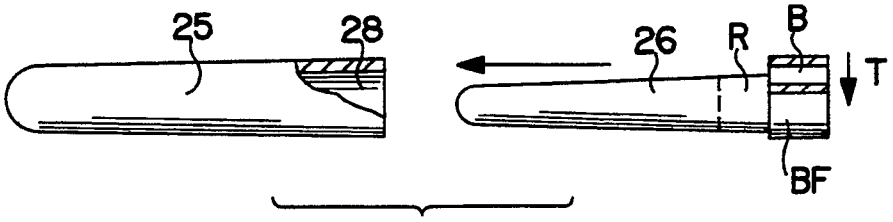
FIG. 10 shows an embodiment of a color hood of the present invention.

As shown in FIG. 6 the multi-color luminous means (15) comprises a hood (H2) and a printed circuit board (27) providing the red LEDs (DR1) and the blue or green LEDs (DB1). The hood (H2) comprises an outer tapered through tube (25) which is notched through inwardly and an inner tapered through tube (26) covered with blue or green reflective films (BF) and red reflective films (RF) alternately on the blue LED means (B) and the red LED means (R) divided by partitions (24), as shown in FIGS. 4, 7 and 10. The printed circuit board (27) is inserted into the adapter (19) in the funnel means (13) of the cell means (12) through the stem (21) to connect with the power source (P2) electrically, and is also connected mechanically by a screw of the outer tapered through tube (25) with an outer wall or connection (14) of the funnel means (13). The stem (21) of the printed circuit board (27) is firmly held in a bushing of screw (22') which is adhered to the partition (24) between the blue LED portions (B) and the incandescent bulb portion (W).

Figure 8:
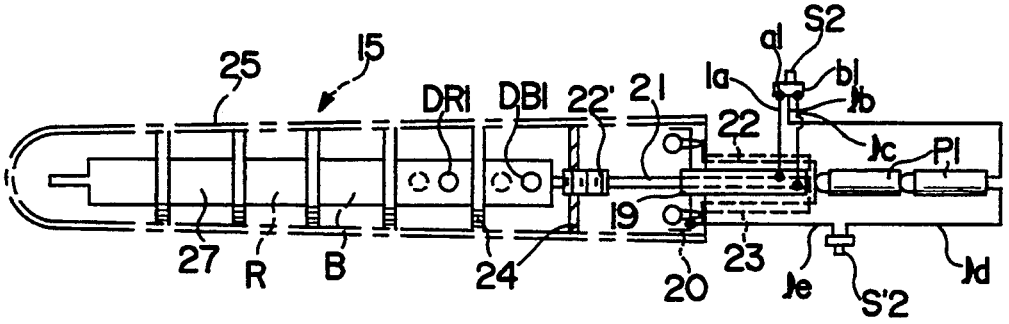
FIG. 8 shows an illustrative embodiment of the electrical connection for the multi-color signal light in FIG. 5.
Figure 9:
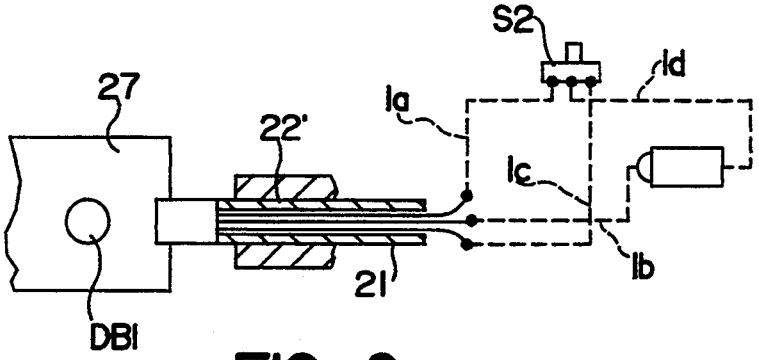
FIG. 9 shows an illustrative embodiment of the electrical connection between a power source and the leads from a printed circuit board.

A connection of the multi-color luminous portion (15) and the power source (P1) such as the cells may be established through the stem (21) of the printed circuit board (27) as shown in FIG. 8 and 9. A positive lead (1a) of the red color LED, a positive lead (1c) of the blue color LED and a common negative lead (1b) of the red and blue color LEDs may pass through the stem (21) to connect electrically with the power source (P2) and the primary switch (S2) at an end of the adapter (19).

An electric connection of the incandescent means or portion (W), is also established through a lead (1d), (1e), the secondary switch (S2') and the power source (P1) as illustrated in U.S. Pat. No. 4,348,715.

Thus, all red LED means (R) are turned on simultaneously when a contact of the switch (S2) connects with a terminal (a1) of the positive lead (1a). All blue LED means (B) are also turned on when a contact connects with a terminal (b1) of the positive lead (1c), after the red LED means are turned off. The incandescent bulb portion (W) is turned on and off by the secondary switch (S2') separately from the red and blue LED means.

The hood (25) comprises a transparent tapered outer tube (25) having inwardly notches (28) for the diffused reflection of the color lights emitted from the LEDs and a transparent tapered inner tube (26) which enables the insertion exactly of the tube into the hood. The inner tube (26) is also covered alternately with reflective films (BF) and (RF) having the same colors and same widths as the red and blue LED means (B) between the partitions (24). The reflective color films may be replaced by a plastic color film such as a gelatin paper or a polypropylene film, etc. and may be wound respectively on the inner tube (26) per each color LED means as shown by an arrow (T) or covered with a sheet of the color reflective film which is alternately colored with the blue and red through the surface of said inner tube (26). Both tubes (25)(26) may be the tapered through tube with a screw cover (16), the tapered blind tube or the straight through tube with the screw cover at one end, and their inner tubes may also be inwardly notched through the same as the outer tubes respectively.

Figure 11:
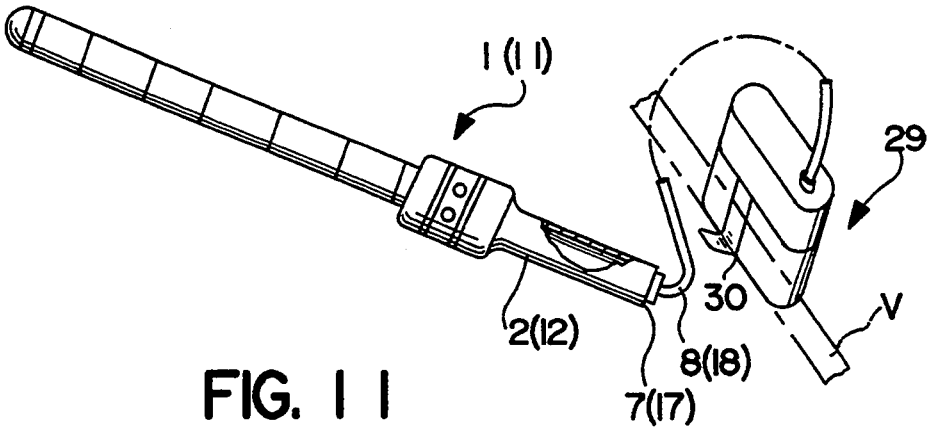
FIG. 11 shows a perspective view of an embodiment of the multi-color signal light combined with a cell box on a belt of the user.

FIG. 11 shows a combination of the present portable multi-color signal light (1) or (11) and cell box (29) connected electrically through a terminal (7) or (17) of the cell portion (2) or (12) and a lead (8) or (18) to the cell box (29). The power source or cells (P1) in the cell portion (2) or (12) are relocated to the cell box (29) which may be attached to a belt (V) of a user by an elastic latch (30) of the cell box (29) for decreasing the weight of the multi-color light (1) or (11). The relocation of the power source (P1) to the cell box (29) on the belt (V) remarkably reduces fatigue of the user for long term use.

Figure 12:
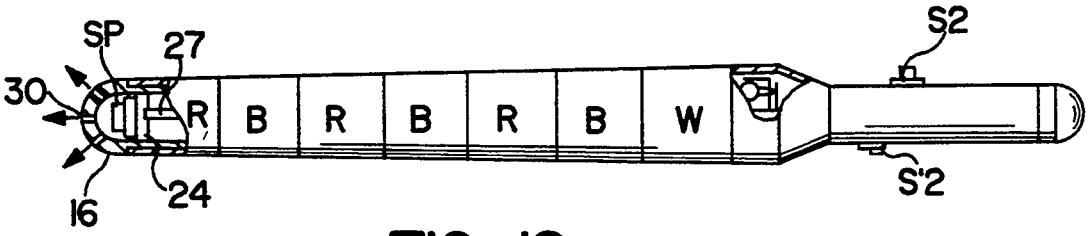
FIG. 12 shows a partial cross-sectional front view of another embodiment of the present multi-color signal light.

FIG. 12 shows also another embodiment of the present invention including incandescent bulb (LP) and the buzzer of FIG. 3. The buzzer (SP) is attached on an extreme point of the partition (24) and covered with a perforated screw cover (16) having small openings (30) so that the sound of the buzzer passes therethrough. The buzzer (SP) is also operated by setting the contact piece (t3) of the secondary three step switch (S'3) with the negative terminal (d3) in the parallel circuit (W) of the multi-color LED means (1) or (11).

Figure 13:
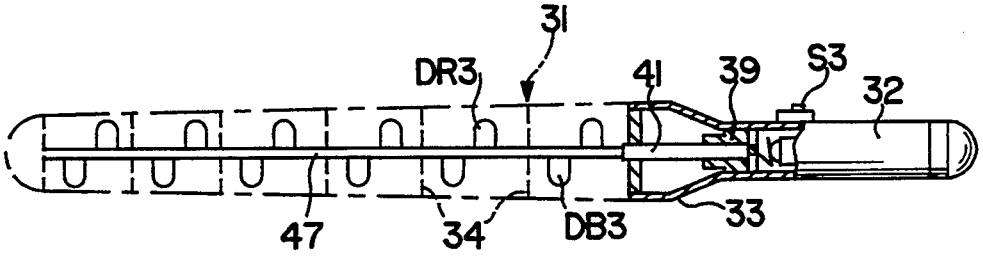
FIG. 13 shows a partial cross-sectional front view of a further embodiment of the present invention.

A further embodiment of the present invention is shown in FIG. 13 in which no incandescent bulb means is provided in the funnel means (33). A printed circuit board (47) of this embodiment provides blue LED means (B) and red LED means (R) separated by partitions (34). The partition (34) are held firmly by a stem (41) in a hole or bushing or sleeve (39) fitted inwardly with a lower portion of the funnel means (33). The printed circuit board (47) is further firmly held by a hood (31) screwed onto an outside of the funnel means (33). A three step switch (S3) on a cell means (32) enables the turning on or off of the red and blue luminous means alternatively the same as the red and blue series LED circuits or means (R)(B) of FIG. 1.

Figure 14:
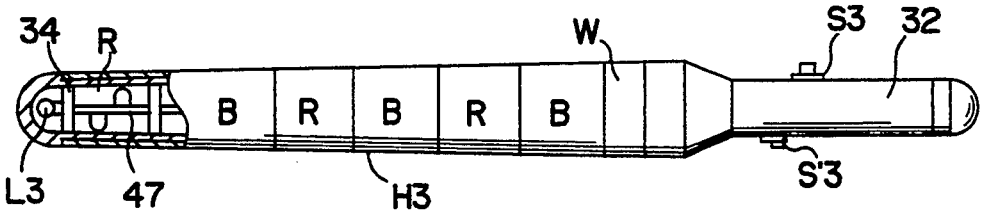
FIG. 14 shows a partial cross-sectional front view of still another embodiment of the present multi-color signal light.

FIG. 14 shows still another embodiment of the present invention which provides an incandescent bulb (L3) at the extreme point of partitions (34) added to the red color LED means (R) in FIG. 13. The multi-color signal light (31) is turned on or off primarily by a three step switch (S3) and a secondary two step switch (S3').

Figure 15:
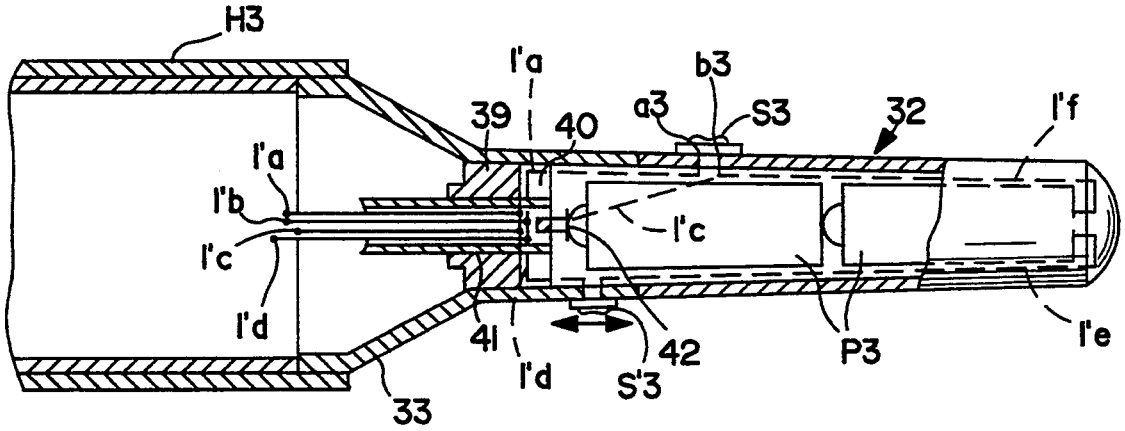
FIG. 15 shows a partial cross-sectional front view of the multi-color signal light of FIG. 13 illustrating a connection of a terminal of the printed circuit board and the cells.

As shown in FIG. 15, the positive leads (1'a)(1'c) from the cell anode for a red LED or LEDs and a blue LED or LEDs, a positive lead (1'd) from the anode for the incandescent bulb (L3) and a negative lead (1'b) which is a common lead of the cell cathode for the red and blue LEDs and the incandescent bulb, provide a turn on or off circuit of the portable multi-color signal light (31) in FIG. 14, is respectively connected electrically through the stem (41) described hereinbefore with the primary three step switch (S3), the secondary two step switch (S'3) and the power source or cells (P3) in the cell portion (32) substantially as shown in FIG. 8.

However, the positive lead (1'd) of the incandescent bulb (L3) is connected with the negative lead (1b) through the switch (S'3)—the positive lead (1e)—power source (P3) and which is turned on or off by the primary three step switch (S3). The red LED means through the positive leads (1'a)–(1'f)—the negative lead (1'b) and the blue LED means, through the positive leads (1'c)–(1'f)—the negative lead (1'b) is alternately turned on or off by the primary three step switch (S3). An outer surface of the stem (41) provides three contacts for the anode of the red and blue LEDs (DR3)(DB3) and the incandescent bulb (L3) for three contacts of the primary three step switch (S3) and the secondary two step switch (S'3) (not shown) and one contact (42) of the common cathode of the above LEDs and the incandescent bulb so as to constitute an electrical connection with the power source (P3) in a slit (4) of the adapter or bushing (39) when the stem (41) was inserted into the adapter (39) in the cell means (32).

Figure 16:
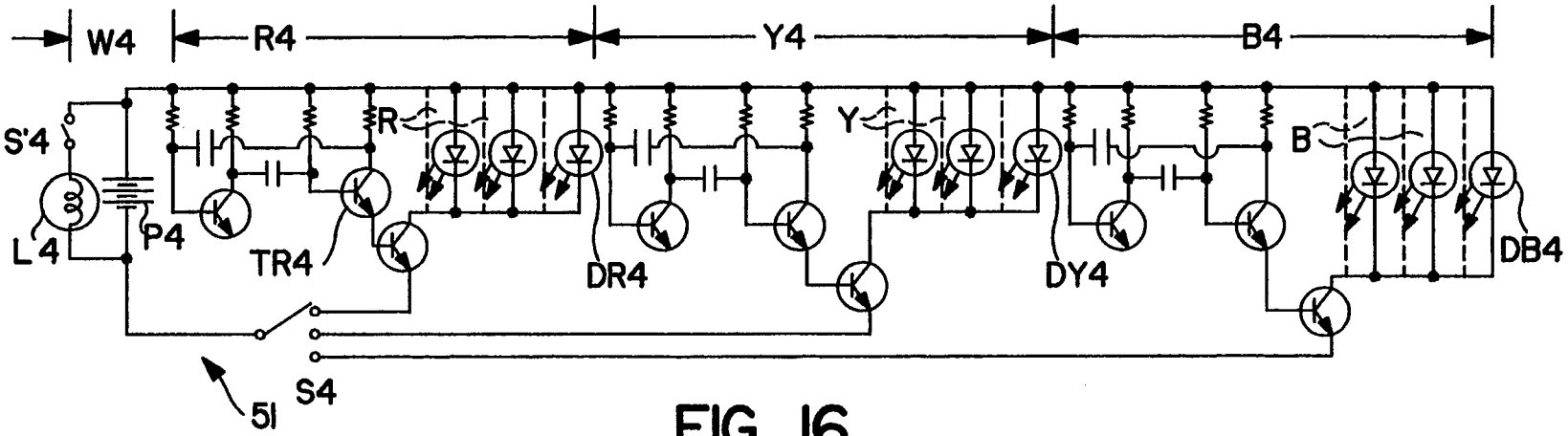
FIG. 16 shows a further embodiment of a circuit for the multi-color signal light including a further embodiment of color LEDs.

In addition, FIG. 16 shows another embodiment of a multi-color signal light (51) comprising a red LED means (R4), a yellow LED means (Y4) and a blue LED means (B4) in series with a power source (P4) including an illumination means of an incandescent portion (W4) in parallel with the red, blue, yellow LED means (R4) (B4), and (Y4). The circuit means of the portable multi-color signal light (51) provides a primary four step switch (S4) and a secondary two step switch (S'4) to alternately turn on or off the red color LEDs (DR4), the yellow color LED (DY4), the blue color LEDs (DB4), and the incandescent bulb (L4) by the operation of the above both switches. The flash interval of the color LEDs is also controlled by the transistors (TR4) connected with the resistances and condensers, per each color LED portion (R), (Y), and (B).

Figure 17:
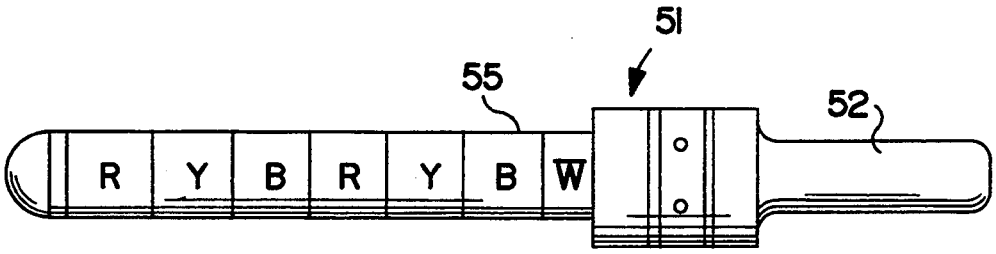
FIG. 17 shows an embodiment of a front view of the multi-color signal light including a circuit of FIG. 16.
Figure 18:
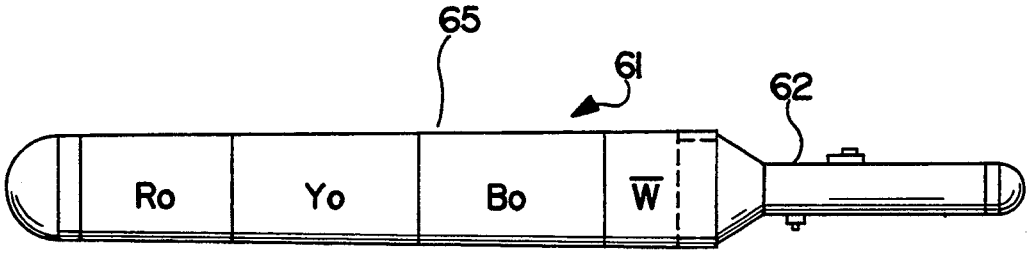
FIG. 18 shows an embodiment of a front view of an another multi-color signal light including a circuit of FIG. 16.

The color LED means in the multi-color luminous means (55) may be arranged alternately in order of the red (R), the yellow (Y) and the blue (B) except for the illumination portion (W) at a joint portion or an extreme point portion of said multi-color luminous means, as shown in FIG. 17, or arranged in one order of the red LED portion (Ro), the yellow LED portion (Yo), the blue LED portion (Bo) and the illuminative means (W) only, as shown in FIG. 18, however, said color LED portions of the multi-color signal light (61) may include respectively more LEDs than the color LED means in FIG. 17 due to the enhancement of their brightness.

All embodiments of the present invention described hereinbefore, may be combined with the cell box (29) on the belt after the cells or power source are relocated from the cell portion (2)(12) to decrease the weight of the portable multi-color signal light for long term usage. The multi-color signal light may be set on a car, ship or a pole of a road improvement etc. by suitable means such as an adhesive board to prevent a traffic accident, in addition to the original use of the portable signal light.

As mentioned before, the blue LED is also unsatisfactory to be used as a signal light for it has a very feeble brightness and very high price. Accordingly, the green LED may be used with or without a blue film for the blue LED because its light is visible almost as well as the blue color under night-time conditions and at a very low price.

The cell means (2)(12) and the funnel means (3)(13) may respectively be manufactured of a plastic material by an injection mold, however, they may also be manufactured of a metallic material such as tin plate for the simple connection between the power source and the LED circuit board.

While there has been described and pointed out the fundamental novel features of the present invention as applied to preferred embodiments, it will be understood that various omissions and substitutions and changes in the form and details of the signal light illustrated and its circuit or construction may be made by those skilled in the art, without departing from the spirit of the invention.

The invention, therefore, is limited only as indicated by the scope of the following claims:

I claim:

1. A multi-color signal light comprising:

light means comprising at least one color LED means disposed longitudinally along the extent of a hood means and at least one incandescent lamp means disposed in the hood means and spaced from the color LED means;

the hood means comprising tube means having an outer light permeable tube surrounding an inner light permeable tube, the outer tube having means for diffusing light transmitted through the inner tube;

the hood means having a longitudinal interior divided by diametrically disposed partitions to form a chamber for respective color LED means, the partitions being supported by the tube means;

a power source means electrically connected to the color LED means and the incandescent lamp means for energizing the LED means and the incandescent lamp means;

at least two switch means connected to the power source means and respectively to the color LED means and the incandescent lamp means for selectively and independently electrically connecting the power source to the color LED means and the incandescent lamp means;

the switch means being disposed on a longitudinal extension of the hood means;

a printed circuit board disposed in and supported by the tube means, the board supporting the color LED means; and an adapter extending longitudinally from the hood means and connected to the hood means for supporting the incandescent lamp means.

2. The signal light of claim 1 wherein the adapter is surrounded by a funnel connecting the hood means with the longitudinal extension of the hood means.

3. The signal light of claim 1 wherein the color LED means is electrically connected in a parallel circuit with the incandescent lamp means.

4. The signal light of claim 1 wherein the incandescent lamp means is disposed in a chamber of the hood means located nearest to the longitudinal extension of the hood means.

5. A multi-color signal light comprising:

light means comprising at least one color LED means disposed longitudinally along the extent of a hood means;

the hood means comprising tube means having an outer light permeable tube surrounding an inner light permeable tube, the outer tube having means for diffusing light transmitted through the inner tube;

the hood means having a longitudinal interior divided by diametrically disposed partitions to form a chamber for respective color LED means, the partitions being supported by the tube means;

a power source means electrically connected to the color LED means for energizing the LED means;

switch means connected to the power source means and to the color LED means for electrically connecting the power source to the color LED means;

the switch means being disposed on a longitudinal extension of the hood means; and a printed circuit board disposed in and supported by the tube means, the board supporting the color LED means.

6. The signal light of claim 5 wherein the hood means is connected to the longitudinal extension of the hood means by a funnel.

7. The signal light of claims 1 or 5 further comprising a buzzer electrically connected to the power source by a further switch means.

8. The signal light of claim 7 wherein the buzzer is disposed at a longitudinal end of the hood means;

and means for covering the buzzer, the cover means having openings to permit sound to pass therethrough.

9. The signal light of claims 1 or 5 wherein the power source is located in the longitudinal extension of the hood means.

10. The signal light of claims 1 or 5 wherein the power source is disposed in a cell box separate from the hood means and electrically connected to the switch means.

11. The signal light of claims 1 or 5 wherein the tube means not tapered.

12. The signal light of claims 1 or 5 wherein the tube means is tapered with the larger diameter nearer to the longitudinal extension of the hood means.

13. The signal light of claims 1 or 5 wherein the color of the LED means is selected from the group comprising: red, green, blue and yellow.

14. The signal light of claims 1 or 5 wherein the color emitted from the LED means is transmitted through a colored film.

15. The signal light of claims 1 or 5 wherein the light from the incandescent lamp is transmitted through a colored film.

16. The signal light of claims 1 or 5 wherein the switch means is located on the longitudinal extension of the hood means.

17. The signal light of claims 1 or 5 wherein circuit means for controlling the flash interval of the light means is connected to the power source and the light means.

18. The signal light of claims 1 or 5 wherein the color LED means comprises at least two different colors disposed alternately in the chambers of the hood means.

19. The signal light of claim 18 wherein the switch means associated with the color LED means is multistep to electrically alternatively connects the power source to only one color LED means and simultaneously energizes all LED means of the same color.

20. The signal light of claims 2 or 6 wherein a flange extends diametrically across the smaller diameter of the funnel and a stem extends through the funnel between the printed circuit board and the flange.

21. The signal light of claims 2 or 6 wherein an assembly means is disposed in the funnel and between the printed circuit board and the longitudinal extension of the hood means, the assembly means having passages for the electrical connection of the light means and the switch means and the power source means.

22. The signal light of claims 1 or 5 wherein a series circuit connects a plurality of color LED means.

* * * * *